US008793827B1

(12) United States Patent
Smart et al.

(10) Patent No.: US 8,793,827 B1
(45) Date of Patent: Aug. 5, 2014

(54) FIELD STRETCHER

(71) Applicant: TSG Associates, LLP, West Yorkshire (GB)

(72) Inventors: Colin John Smart, West Yorkshire (GB); Simon Eric Pennells, West Yorkshire (GB); Mark Pittaway, West Yorkshire (GB)

(73) Assignee: TSG Associates, LLP, Halifax, West Yorkshire (GB)

( * ) Notice: Subject to any disclaimer, the term of this patent is extended or adjusted under 35 U.S.C. 154(b) by 0 days.

(21) Appl. No.: 13/836,731

(22) Filed: Mar. 15, 2013

(51) Int. Cl.
*A61G 1/013* (2006.01)

(52) U.S. Cl.
USPC ..... 5/627; 5/628; 128/870

(58) Field of Classification Search
USPC ..... 5/625–629, 81.1 HS; 128/870; 280/19
See application file for complete search history.

(56) References Cited

U.S. PATENT DOCUMENTS

| | | | | |
|---|---|---|---|---|
| 4,064,574 | A | 12/1977 | Schnitzler | |
| 4,442,557 | A | 4/1984 | Clemens | |
| 4,723,327 | A | 2/1988 | Smith | |
| 4,742,588 | A | 5/1988 | James | |
| D306,148 | S | 2/1990 | Dannals | |
| 4,922,562 | A | 5/1990 | Allred | |
| D329,216 | S | 9/1992 | Beeley | |
| D332,930 | S | 2/1993 | Clark | |
| 5,189,746 | A | 3/1993 | Horie | |
| 5,190,056 | A | 3/1993 | Hull | |
| D346,346 | S | 4/1994 | Johnson | |
| 5,317,770 | A | 6/1994 | Sakurai | |
| 5,333,335 | A | 8/1994 | Gastle | |
| 5,386,604 | A | 2/1995 | Ricketts | |
| 5,398,358 | A | 3/1995 | Mercke | |
| 5,442,821 | A | 8/1995 | Weeks | |
| 5,539,945 | A | 7/1996 | Rosenberg | |
| 5,598,592 | A | 2/1997 | Castellani | |
| 5,729,850 | A * | 3/1998 | Eskeli | 5/621 |
| D394,929 | S | 6/1998 | Ahumada | |
| 5,787,529 | A | 8/1998 | Landes | |
| 5,839,137 | A | 11/1998 | Butler | |
| 5,978,989 | A | 11/1999 | Chavez | |
| 6,427,271 | B1 | 8/2002 | Gadzia | |
| 6,440,160 | B1 | 8/2002 | Cordani | |
| 6,477,728 | B1 * | 11/2002 | Faz | 5/625 |
| 6,634,044 | B1 | 10/2003 | Wright | |
| D486,287 | S | 2/2004 | Liljedahl | |
| D488,107 | S | 4/2004 | Saunier | |
| 6,823,542 | B2 | 11/2004 | Berge | |
| 6,871,368 | B2 | 3/2005 | Calkin | |
| D506,710 | S | 6/2005 | Hurtado | |
| 7,043,785 | B2 | 5/2006 | Dimentmen | |
| 7,467,419 | B2 | 12/2008 | O'Neal | |

(Continued)

FOREIGN PATENT DOCUMENTS

EP WO2010052316 A1 * 4/2012

*Primary Examiner* — Michael Trettel
(74) *Attorney, Agent, or Firm* — Christopher J. Knors; Moore & Van Allen PLLC

(57) ABSTRACT

A field stretcher comprising a subject transporting portion, the subject transporting portion comprising a region capable of forming a subject retaining compartment for retaining a subject positioned within the subject transporting portion, is disclosed and described. A method of transporting a subject generally horizontally, is provided, the method comprising providing a field stretcher comprising a subject transporting portion, positioning a subject in the subject transporting portion, and drawing at least a portion of the subject transporting portion about at least a portion of the subject.

18 Claims, 6 Drawing Sheets

(56) References Cited

U.S. PATENT DOCUMENTS

| | | | | |
|---|---|---|---|---|
| D617,691 | S | 6/2010 | Smart | |
| 7,865,986 | B2 | 1/2011 | Smart | |
| 8,065,765 | B2 * | 11/2011 | Rincon | 5/627 |
| 8,286,284 | B2 * | 10/2012 | Fee et al. | 5/628 |
| 8,528,137 | B2 * | 9/2013 | Johnson et al. | 5/628 |
| 2003/0000017 | A1 | 1/2003 | Byerrum | |
| 2003/0106155 | A1 | 6/2003 | Arai | |
| 2004/0088794 | A1 | 5/2004 | Calkin | |
| 2004/0226095 | A1 * | 11/2004 | Lohse et al. | 5/627 |
| 2006/0137097 | A1 | 6/2006 | Frost | |
| 2006/0162137 | A1 | 7/2006 | Hjort | |
| 2007/0136950 | A1 | 6/2007 | Zuercher | |
| 2007/0163047 | A1 | 7/2007 | Noonchester | |
| 2007/0199148 | A1 | 8/2007 | Ricketts | |
| 2008/0184488 | A1 | 8/2008 | Fee | |
| 2009/0038076 | A1 | 2/2009 | Giduck | |
| 2009/0288255 | A1 * | 11/2009 | Sakurai et al. | 5/625 |
| 2010/0005593 | A1 * | 1/2010 | Bowling et al. | 5/627 |
| 2013/0227791 | A1 * | 9/2013 | Kostron et al. | 5/629 |
| 2013/0276235 | A1 * | 10/2013 | Kenalty et al. | 5/627 |

* cited by examiner

FIELD STRETCHER

TECHNICAL FIELD

The present disclosure relates to field stretchers, particularly for recovering wounded soldiers from field.

BACKGROUND

Field stretchers are used for transporting wounded individuals in the field of battle or other disasters. They differ from medical stretchers used in medical facilities in that they are designed to be lightweight and compact, enabling the field stretcher to be carried about an individual person.

SUMMARY

It is an object of aspects of the present invention to provide a solution to the above mentioned or other problems.

In one embodiment, a field stretcher is provided. The field stretcher comprising a top end and a bottom end; a subject transporting portion; a perimeter around the top end, the bottom end, and the subject transporting portion; a subject retaining compartment for retaining a subject positioned within the subject transporting portion; means operable to draw a portion of the subject transporting portion about a portion of a subject; one or more handles connected at each end about the perimeter; and a loop positioned at the top end, the loop connected at each end to the perimeter, the total length of the loop greater than the one or more handles, the loop operable for dragging the stretcher along a surface.

Aspects of the above embodiment includes wherein the loop is of a length for dragging the stretcher by a single person in an upright position. Other aspects alone or in combination with the above aspects includes wherein the subject transporting portion, in a drawn configuration, generally corresponds in shape to a subject with or without one or more amputated limb. Other aspects alone or in combination with the above aspects includes an adjustable loop. Other aspects are wherein the field stretcher has a first state having a compact form and a second state having an uncompacted form.

Other aspects alone or in combination with the above aspects includes wherein the one or more handles are positioned between the top end and the bottom end at predetermined positions. The predetermined positions can exclude the top end.

Other aspects alone or in combination with the above aspects includes wherein the stretcher further comprises a retaining region forming a part of the subject retaining compartment. The retaining region can be drawn together with the lower region of the subject transporting portion.

Other aspects alone or in combination with the above aspects includes wherein the means operable to draw a portion of the subject transporting portion about a portion of the subject comprises a drawstring. The drawstring can extend within an edge of the perimeter positioned at least at a section of the subject transporting portion.

Other aspects alone or in combination with the above aspects includes wherein at least a portion of the subject transporting portion comprises a dual skin of material. The subject transporting portion can comprise a retaining compartment between portions of the dual skin of material. Other aspects alone or in combination with the above aspects includes wherein the retaining compartment comprises a pad selected from a mattress pad, a heating pad, an absorbent pad, or combinations thereof.

Other aspects alone or in combination with the above aspects includes wherein at least a portion of the subject transporting portion comprises an abrasion resistant fabric, static resistant fabric, a flame-retardant fabric, or combinations thereof.

Other aspects alone or in combination with the above aspects includes wherein at least a portion of the subject transporting portion comprises an abrasion resistant coating, static resistant coating, a flame-retardant coating, or combinations thereof.

In a second embodiment, a method of transporting a subject generally horizontally by one person in an upright position is provided, the method comprising providing a field stretcher as defined in first embodiment; positioning a subject in the subject transporting portion; drawing at least a portion of the subject transporting portion about at least a portion of the subject; and transporting the field stretcher with the subject in a substantially horizontal position.

All of the features contained herein may be combined with any of the above aspects and in any combination.

BRIEF DESCRIPTION OF THE DRAWINGS

For a better understanding of the invention, and to show how embodiments of the same may be carried into effect, reference will now be made, by way of example, to the accompanying diagrammatic drawings in which.

DETAILED DESCRIPTION

Figure 1:
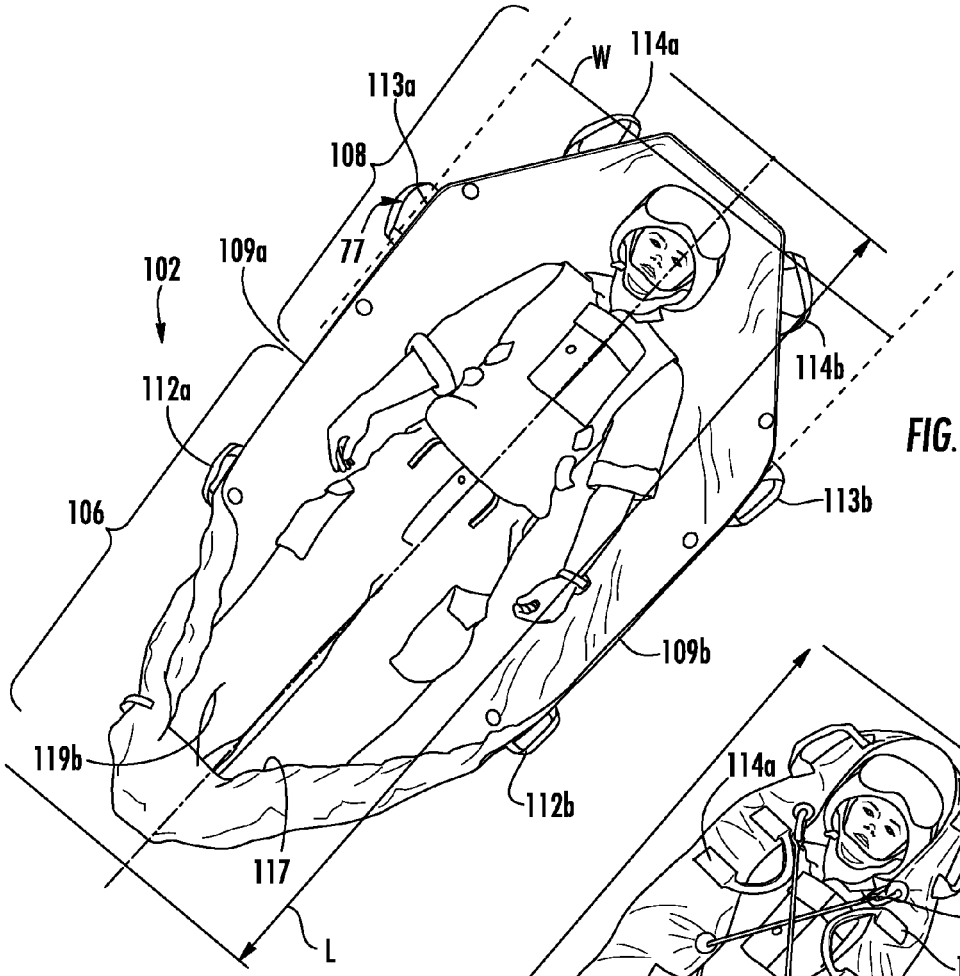
FIG. 1 shows a prospective view of a field stretcher embodiment of the present disclosure in a pre-transport state.

Conventional field stretchers comprise a piece of fabric material upon which an injured person may be placed, the stretcher configured for dragging, pulling, or carrying to a position of safety. Inadequacies with this type of known stretcher exist in that a wounded individual may roll off or slide down the stretcher during transport. This is of particular concern in instances where such stretchers are used to recover soldiers or other casualties from mine fields, having been wounded by a land mine or improvised explosive devices (I.E.D.s). Often in such cases, the casualty's legs may have been severely injured or removed, and as such, the causalty may have a significantly reduced body length. In such scenarios, conventional field stretchers are inappropriate since they are too large, and promote the incidence of casualty's rolling and/or sliding off or down the stretcher. The inappropriate length of the know field stretchers in these situations dictates, among other issues, that carry handles are not in the optimum place for safe subject transport and/or that more than one responder would be needed to remove such causalty from the scene, potentially placing others at risk or delaying treatment or services to the causalty.

It is also of concern that the conventional stretchers do not provide sufficient means for rapid and ergonomic removal of the casualty to a safe position or location, or, require multiple rescuers. Co-assigned U.S. Pat. No. 7,865,986, incorporated herein in its entirety, describes a stretcher having carry handles sufficiently placed about the perimeter thereof and drawing means to contain soldiers or other casualties from mine fields, having been wounded by a land mine or improvised I.E.D.s. Yet, improvements in the ability to quickly remove the casualty from the point of injury, afford transportation of the casualty by one person ergonomically, and provide such stretcher in a compact form prior to deployment, are desirable.

The various aspects of the field stretcher disclosed and described herein are provided for the removal of injured or incapacitated individuals, making it possible to move, or generally horizontally slide, the individual from one place to another by one person ergonomically. In one aspect, the field stretcher disclosed and described herein provides for the removal of injured or incapacitated individuals, generally horizontally from one place to another by only one person ergonomically. In addition, the various aspects of the field stretcher configuration provide for the containment of individuals who are otherwise likely to roll or slide off or down a conventional stretcher due to the partial or total loss of one or both lower body appendages, or total loss of consciousness.

Referring to FIGS. 1-7 there is provided a field stretcher 102 having a subject transporting portion 104 essentially corresponding to a longitudinal length (L) of the stretcher having opposing top/bottom surfaces 103*a*/103*b*, respectively. In one aspect, L is inclusive of a maximum length for the stretcher 102 when the stretcher is laid out in a configuration ready to be used, which can be between about 3-10 feet (or about 1-3 meters). The stretcher may preferably be in the form of a dual skinned fabric material in a general sheet-like form that may be stitched together at predetermined positions and/or edges about the form. The subject transporting portion is depicted as generally coffin shaped in plan, for example, being an irregular hexagon, to contour the general shape of a human body. In this manner, the subject transporting portion is generally elongate along axis L and comprises a lower region 106, where a lower part of a subject's body would typically be situated in use, and an upper region 108 where an upper part of a subject's body would typically be situated, in use or prior thereto.

Pairs of handles 111*a*, 111*b*, 112*a*, 112*b*, 113*a*, 113*b*, and 114*a*, 114*b* are situated at edges 109*a*, 109*b* of stretcher 102. A first pair of handles 112, are situated at either side of the subject transporting portion 104 at the widest part (W) thereof (corresponding generally to the proximity of a subjects shoulders), which would allow the sides of lower region the stretcher about the subject and readily present to the responders during use as shown in FIG. 1.

A pair of handles 114*a*, 114*b*, are situated at upper region 108 of the subject transporting portion 104, for example, adjacent or in proximity to a subject's head or neck, and present to the same or another responder when in use. Handles 112*a*, 112*b* are situated in lower region 106 slightly below that of a subject's waist. Additional handles 111*a*, 111*b* are on side of stretcher 102 near where the feet of a subject would be located, or the distal portion of lower region 106.

The stretcher may be configured of a dual skin of material comprising an upper skin and lower skin. In this configuration, the material may be configured to provide one or more compartments at predetermined positions about the stretcher. The compartments can be formed by at least one optional lateral slit (not shown) in an upper skin of an optional dual skin subject transporting portion 104 and/or toward the lower region 106 for introducing padding, heating elements, absorbent material, etc.

Figure 2:
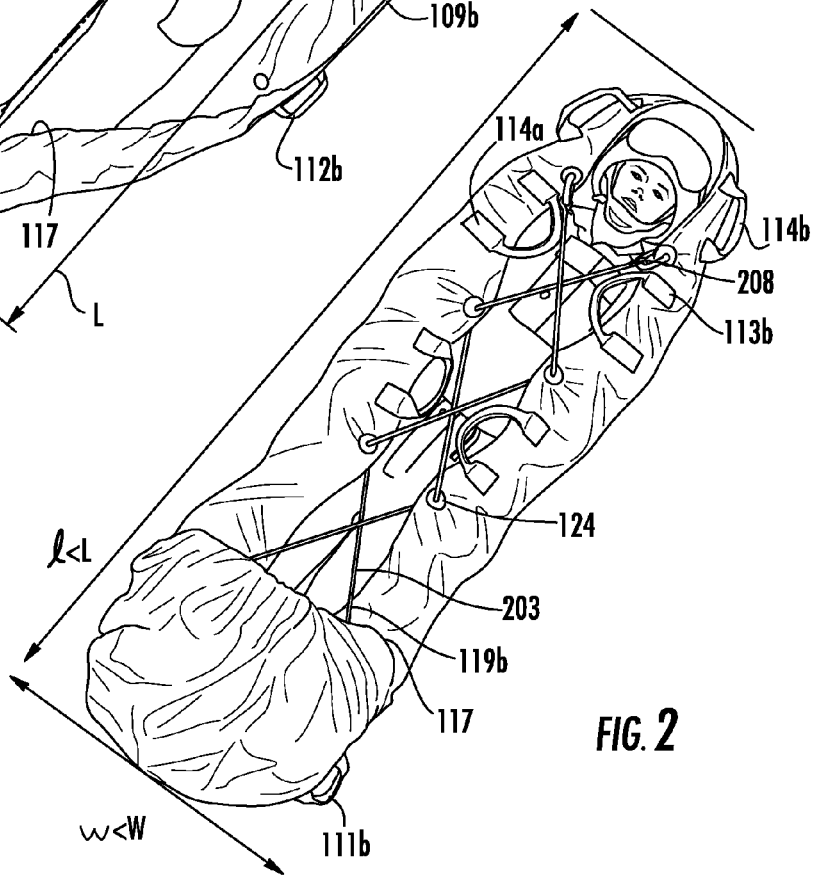
FIG. 2 shows a plan view of the field stretcher embodiment of FIG. 1, in a fully deployed, transport state.

FIG. 2 depicts stretcher 102 in a fully deployed, transport state with casualty, depicting "gathered up" section 106 and additional securement means 203 explained in more detail below.

Lower surface 103*b* of field stretcher 102, at least a portion thereof which contacts a surface (e.g., earth, concrete, carpet, vegetation, etc.) during transport is preferably of wear resistant material, optionally with static resistant or flame-retardant or lubricant, or combinations of these properties, or may be a material surface treated to provide one or more of anti-wear resistance, static resistance, flame-retardancy, lubricity, or combinations thereof, to facilitate or improve the ability of the stretcher to transport across the surface or prevent or eliminate burning, ripping, or tearing of surface 103. The surface of subject transport portion 104 that contacts the subject may also be treated, for example, with an anti-infective, anti-bacterial, flame resistance, and/or stain-resistant coating, and combinations thereof.

In the accessible compartments (not shown) provided between the upper skin and lower skin of the dual skinned subject transporting portion 104 may be inserted at least one pad (e.g., thermal pad, mattress, adsorbent pad, or other support structure) (not shown) to increase the comfort of a subject or provide some level of medical assistance to the subject situated thereon. The pad may comprise an "instant heat" pak or similar thermally-actuated device to provide warmth, or the pad may be a combination of heating sources and supporting structure or absorbing material. The pad may be secured in place by one or more cooperative Velcro patches, buttons, snaps, latches, or similar fasteners. In another aspect, the personal belongings or severed parts of the subject may be contained in the compartment of the stretcher.

Figure 6:
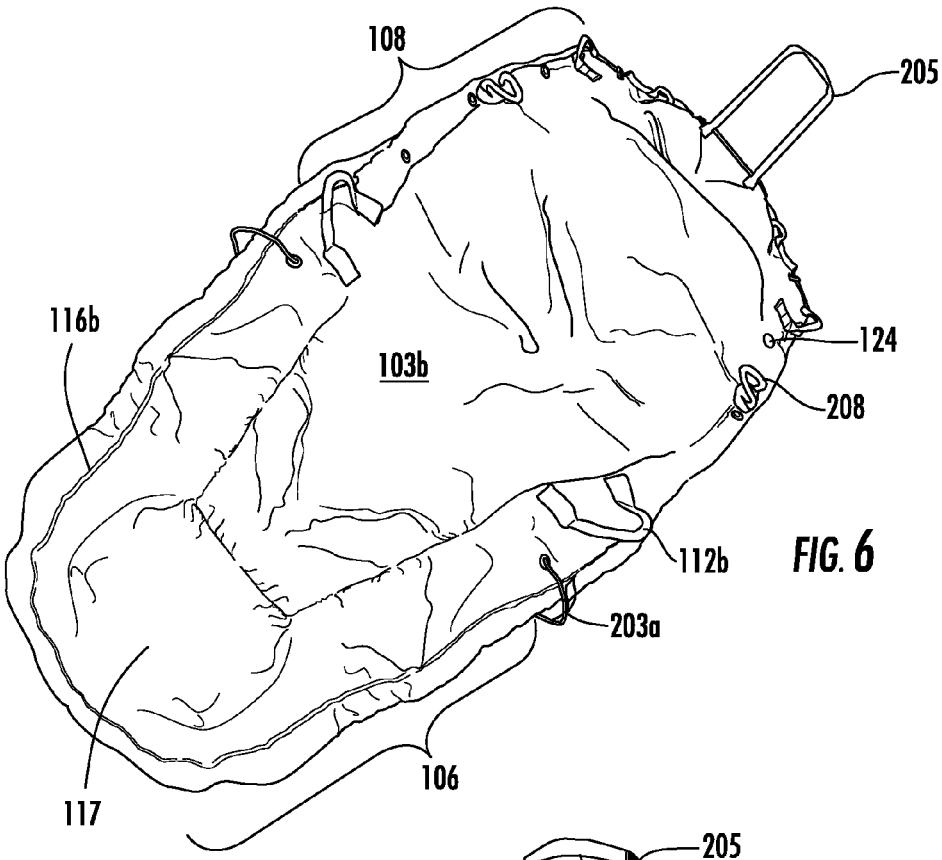
FIG. 6 shows a prospective view of another embodiment of a field stretcher as disclosed herein.

With reference now to FIGS. 1, 2, 3A-3C and 4A-4B, lower region 106 comprises a generally upstanding covering portion 117 when lower surface 103*b* is placed on a surface. In one aspect, subject transporting portion 104 is formed from a fabric material and around the edge of the covering portion 117 and the lower region 106 of the subject transporting portion 104 is a drawing member operable to draw the lower region 106 about the casualty. Such means include drawstrings, chains, straps, wire, ribbon, thread, tape, and the like. Hereinafter, the use of "drawstring" is representative of a drawing member. In one aspect a lower drawstring 119*b* is housed in a guide or sewn seam edge 116*b* (FIGS. 3, 6). Lower drawstring 119*b* is threaded about seam edge 116*b* of the lower region 106 and about a portion of the perimeter of the stretcher with some excess length protruding from the lowest point of lower region 106 for user, lower drawstring 119*b* being secured to the stretcher between the regions 108 and 106. Lower drawstring 119*b* can have a toggle 118*b* or other cord clamp for controlling and/or securing the drawstring in a drawn state. Lower drawstring 119*b* can be of one piece construction forming a loop at toggle 118*b*, or can be two or more strings, for example, a single string on each side of the stretcher joining at the top portion with toggle 118*b*, each single string sewn or attached to the lower section of portion 106, e.g., at the midline (approximately between regions 106 and 108). In one aspect, during use by rescuer, activation of lower drawstring 119*b* provides a reduction (l) which is less than (L), in the initial uncompromised length (L) along the longitudinal axis of stretcher 102 of between about 5 to about 30 percent, or about 10 to about 25 percent. Likewise, a reduction in width (w), which is less than (W) occurs by activating drawing member. In this way, stretcher 102 is adaptable from an uncompromised length of a casualty who has not sustained a loss of lower limb(s) or is a child, to the compromised length of the casualty that has suffered loss of one or more lower limbs.

Figure 3A:
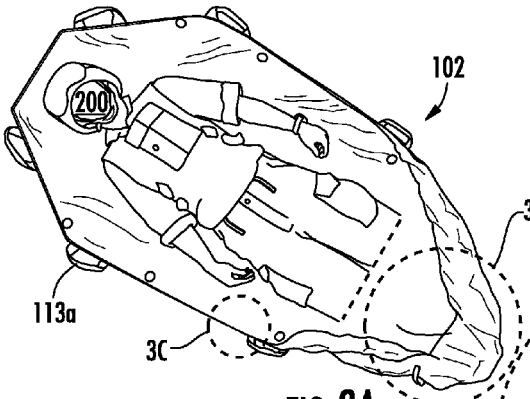
FIGS. 3A, 3B, and 3C show a plan view of the field stretcher embodiment of FIG. 1, showing expanded views 3B and 3C, respectively.
Figure 3B:
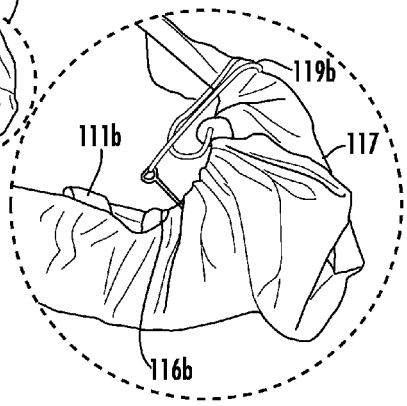
Figure 3C:
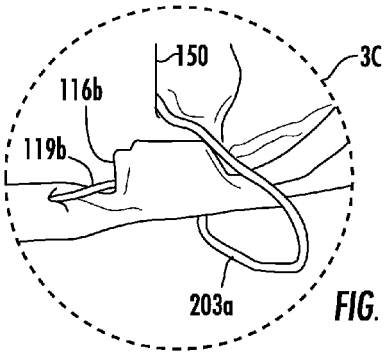

Referring to FIGS. 3A-3C, the lower region and drawstring 119*b* is depicted with expanded views 3B and 3C of FIG. 3A. FIG. 3B depicts drawstring 119*b* operable, for example, by holding the toggle 118*b* and pulling the drawstring 119*b* therethrough to cause at least a portion of lower region 106 and portion 117 to gather up about the subjects lower torso. The toggle 118*b* may serve to hold the drawstring 119*b* in the gathered up configuration. FIG. 3C depicts the secured end of drawstring 119*b* entering/exiting a portion of seam edge 116*b*. FIG. 3C also depicts addition securing means, such as bungee element 203*a* shown with its terminal end secured in pocket 150 between skins of material constituting surfaces 103*a*, 103*b*, for example, and discussed further below.

Figure 4A:
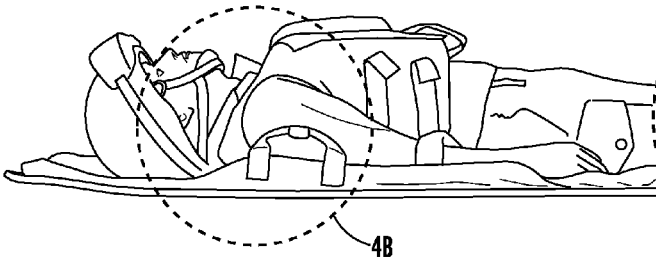
FIGS. 4A and 4B show a partial prospective side view of the upper section of the field stretcher of FIG. 1, showing an expanded view of indicator, respectively.
Figure 4B:
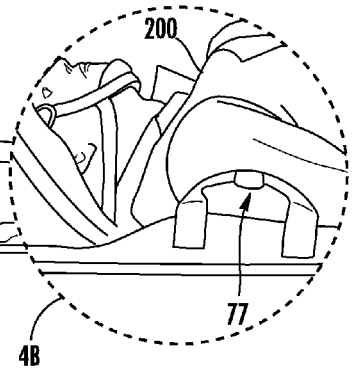
Figures 5A, 5B, 5C, 5D:
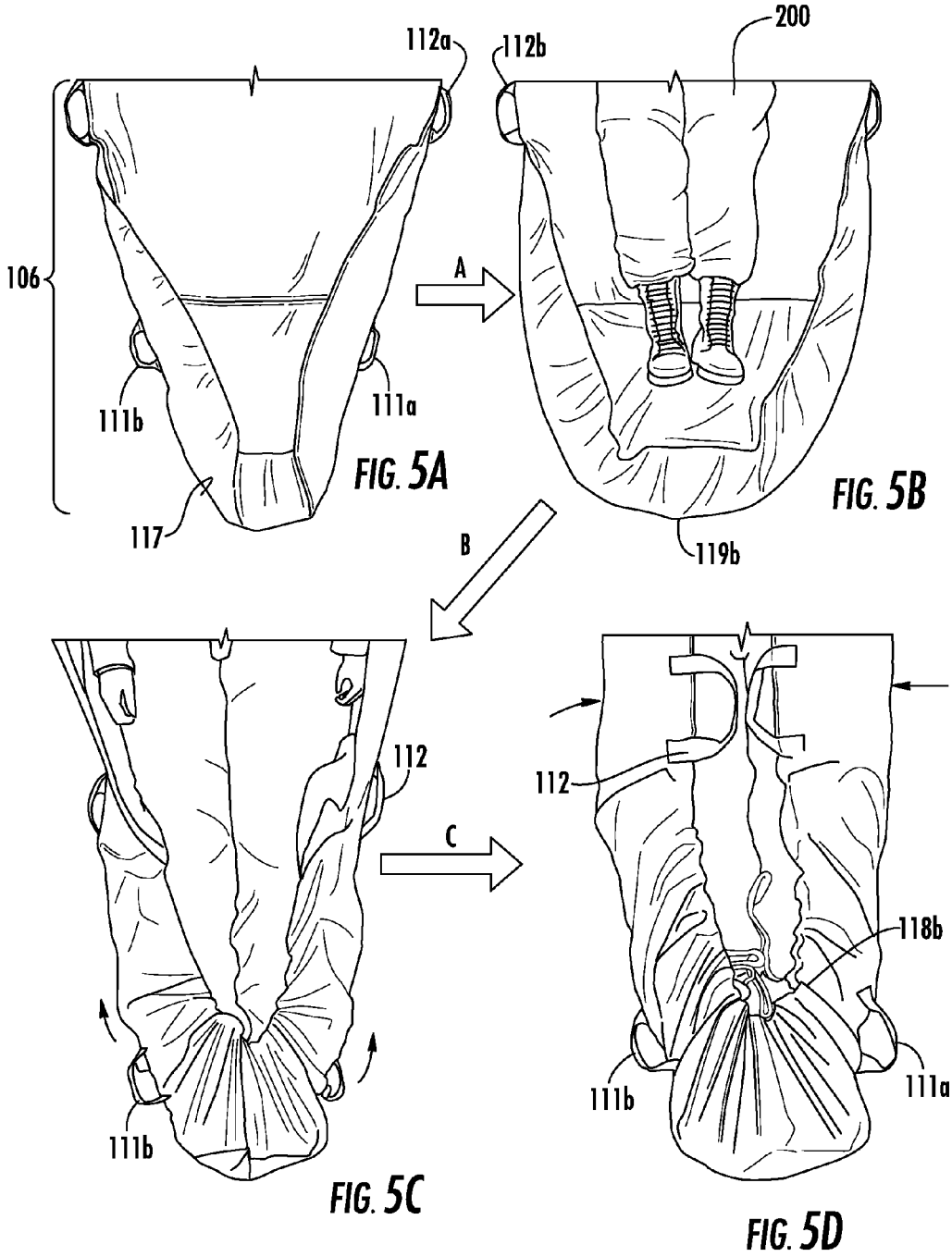
FIGS. 5A, 5B, 5C, and 5D shows an exemplary sequence of operation of the field stretcher of FIG. 1 depicted in a subject pre-transport first state and in a second state having the lower portion drawn about a subject, respectively.

Referring now to FIGS. 4A and 4B, which show a partial side view of stretcher 102 with subject shown 200 shown in supine position and expanded view 4B of handle 113*a*. FIG. 4B depicts exemplary indicator feature 77 located on handle 113*a* which can be used to align the shoulders of the subject for proper placement thereof. Other indicators can be used for casualty alignment, such as specific colored opposing handles on opposing edges (e.g., red handles where shoulders are to be positioned) can be employed, as shown by lighter shaded handles 113*a,b*, for example.

Referring now to FIGS. 5A, 5B, 5C, and 5D, exemplary operation of stretcher 102 lower region 106 is shown. Thus, casualty 200 is placed on surface 103*a* as depicted by arrow A. As shown in step indicated by arrow B, activation of drawstring 119*b* causes lower region 106 and portion 117 to gather up around casualty's legs and/or feet. As shown in step indicated by arrow C, continued activation of drawstring 119B causes further gathering of lower region 106 and portion 117 exposing handles 111*a*, 111*b*, as well as bringing handles 112*a*, 112*b* in close proximity to each as well as edges 109*a*, 109*b* of stretcher 102.

Figure 7:
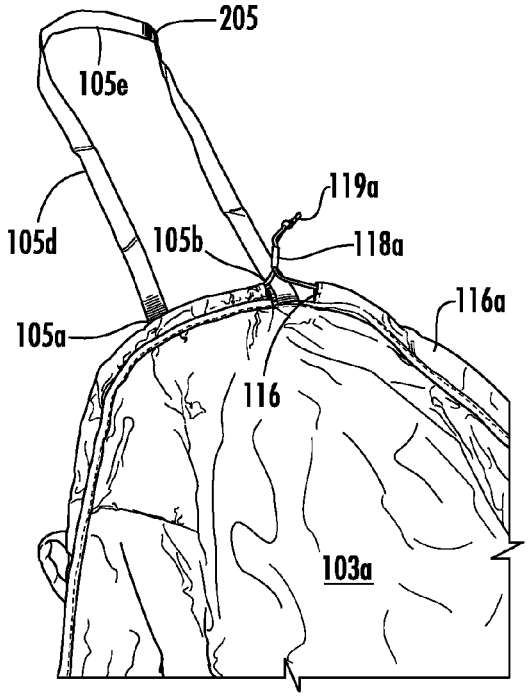
FIG. 7 shows an expanded view of the upper section of the embodiment of FIG. 6.

Referring to FIGS. 6 and 7, an additional embodiment of the present disclosure is depicted with generally the same stretcher design as that shown in FIG. 1, with the addition of loop 205 positioned at upper region 108 of stretcher 102. FIG. 7 depicts an expanded view of the opposing side of that depicted FIG. 6, showing upper region 108 of stretcher 102 with loop 205 having side portions 105*d*, 105*d*, secured to stretcher at proximal positions 105*a*, 105*b* and forming loop at distal end 105*e*. Also shown in FIG. 7 is upper drawstring 119*a* and corresponding toggle 118*a* with upper drawstring 119*a* fed through opening 116 in seam edge 116*a* about stretcher 102. Upper drawstring 119*a*, securable with toggle 118*a*, provides additional support and securement for casualty's head and neck area during transport. When activated, drawstring 119*a* gathers up upper section 104 of stretcher 102 about the head and side of face of the casualty. Padding and/or other elements for support, heat, absorbent, may be provided in upper section of stretcher 102.

Loop 205 can be connected at a first end 105*a* in proximity to the edge or perimeter of the stretcher, and connected at a second end 105*b* in proximity to the edge or perimeter of the stretcher. First end 105*a* can be connected to top surface 103*a* while second end 105*b* can be connected to bottom surface 103*b*. Alternatively, as shown, first and second ends 105*a*, 105*b* are both be connected to lower surface 103*b* of stretcher 102. In one aspect, loop 205 is longer in length (as in extending away a distance from the edge of the stretcher) than either of handles 112, 114*a*, 114*b*. In one aspect loop 205 is configured for a typical responder's arm length so as to provide the responder essentially an upright posture while grasping the loop and transporting (pulling, dragging, lifting) the subject, while the subject remains in an essentially horizontal position. In another aspect, loop 205 is configured for being received by the responder's arm and to drape over the responder's shoulder so as to provide essentially an upright (or non-crouched) posture while transporting the subject in an essentially horizontal position. One or more portions of loop 205 can be padded or otherwise modified or reinforced for comfort, strength, flexibility, texture, and the like. In other aspects, two loops of the same or of different lengths (not shown) can be provided that project in a generally V-type configuration so as to provide essentially an upright posture of two responders while each is, independently, either grasping the loop by hand or draping the loop over a shoulder and transporting the subject in an essentially horizontal position.

In one aspect, the length of loop 205, as measured from the edge of the stretcher to the full extended length of lengths 105*c* and 105*d* to the point of curvature 105*e*, is of a fixed length, between about 8 inches to about 24 inches (about 20 cm to about 61 cm). In another aspect, the length of loop 205 is adjustable, using a clasp or other means, for providing a variable length of between about 8 inches to about 24 inches (about 20 cm to about 61 cm). Loop 205 can be of the same material as that of either skins of the stretcher, or of a material of greater strength or lesser strength than that of the stretcher. Suitable materials for the stretcher and the loop include rope, nylon, polyesters, polyester blends, polyketones, polyolefins, polystyrenes, rayon, cotton blends, polyphenylsufides and/or other engineering resins or engineering plastics.

Figure 8:
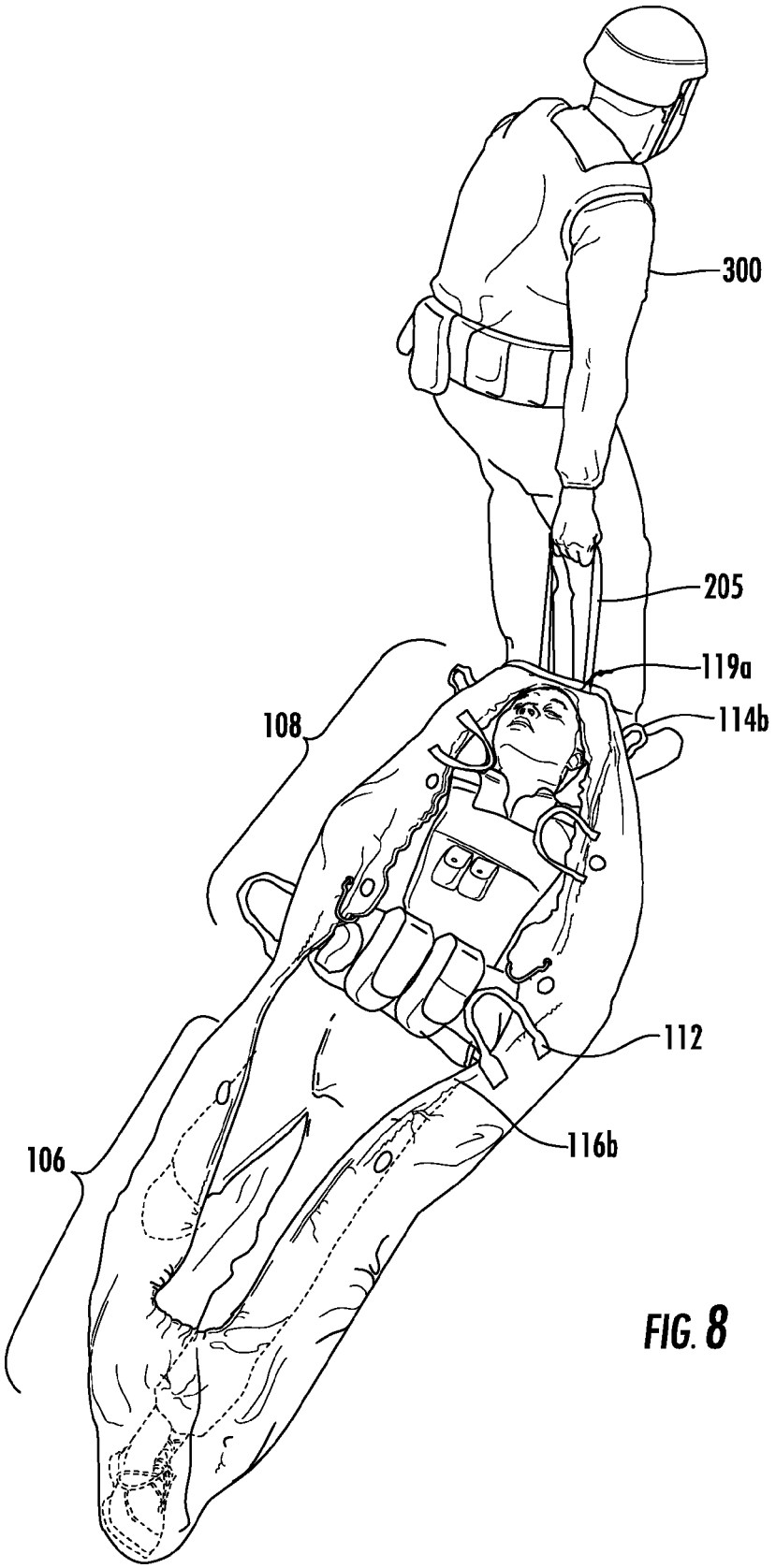
FIG. 8 shows the embodiment of FIG. 6 in a transport mode.

With reference to FIG. 8, there is shown a subject 200 situated on field stretcher 102. The sides of the stretcher 102 are depicted as pulled up over the sides of subject 200 and the covering portion 117 has been gathered up over the subject's lower torso by lower drawstring 119*b* secured by toggle 118*b* as well as upper drawstring 119*a* secured by toggle 118*a* for gathering up upper section of stretcher 102 about head and neck area of casualty 200. In this configuration the subject may be transported, for example, substantially horizontally by one or more responders 300.

Figure 9A:
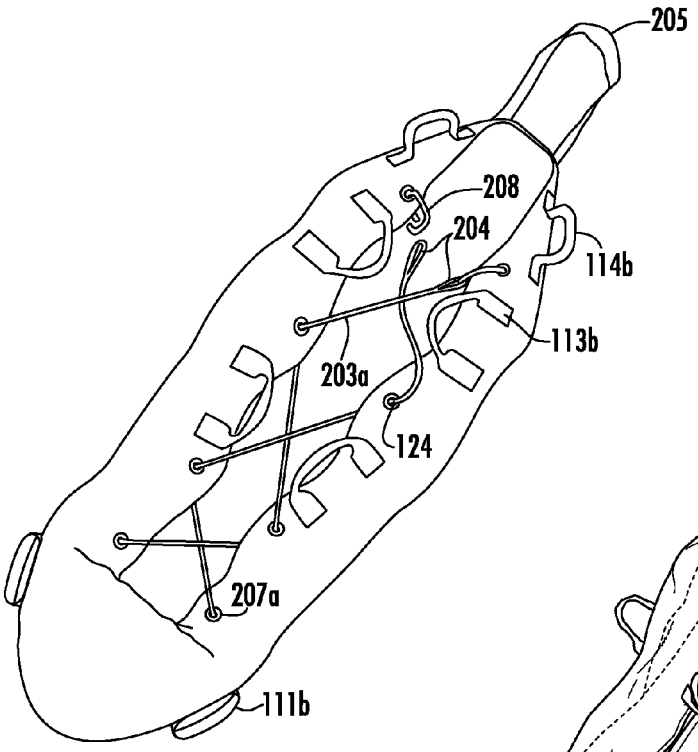
FIGS. 9A and 9B shows a line drawing of the transport mode of the embodiment of FIG. 2, and an embodiment in a transport mode, respectively.
Figure 9B:
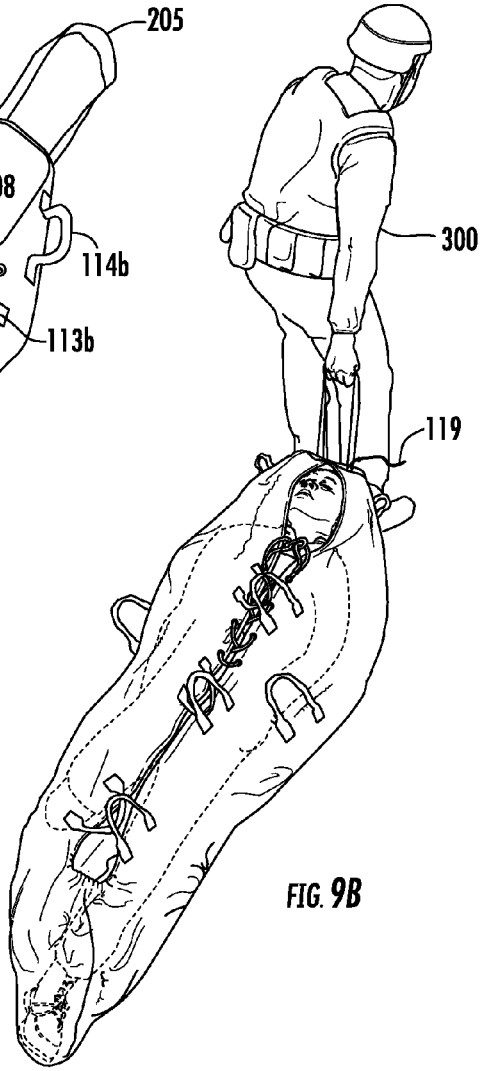

Referring now to FIG. 9A, 9B, stretcher 102 is shown without casualty 200 depicting lacing 203 shown as bungee cords 203*a*, 203*b* secured in lower region 106 on opposing sides of stretcher 102 at points 207*a*, 207*b*. Openings 124 (e.g., grommets or sewn holes) along opposing edges of stretcher 102 provide for "lacing" of elastomeric cord 203 (e.g., bungee cord). Elastomeric cord 203 can be a single cord or two separate cords (as shown as 203*a*, 203*b*) terminating in loop region 204 for securing to securement means 208 at the upper portion of stretcher 102. Attachment means 208 can include clips, hooks, Karabiners, and other clasps or buttons. FIG. 9B depicts casualty 200 being transported in a substantially horizontal position with upper drawstring 119*a* drawn so that the upper region of stretcher 102 is gathered up about head of casualty 200, lower drawstring 119*b* drawn so that lower end of the covering portion 117 and the lower region 106 of stretcher 102 is gathered up around casualty 200 lower torso, and bungee cords 203 threaded through openings 124 and secure to attachment means 208 securely retaining casualty 200.

A field stretcher made in accordance with the present invention allows a subject to be retained within the stretcher 102 and thus when transported, for example by dragging via loop 205, with the possibility of the subject rolling or sliding off the stretcher prevented or eliminated. Also, as discussed above, in the theatre of war, soldiers often sustain major injuries to their feet and legs and, in severe cases, one or more of the legs may be removed by land mines or I.E.D.s. In such a scenario, the elongate extent of the field stretcher of the present invention can be significantly reduced to accommodate a person in this condition securely for transport. The field stretcher disclosed and described, has the further advantage that the handles are situated at appropriate predetermined positions with regard to the subject, because the length of the stretcher 102 is adjustable to suit the subject, and in particular, a subject comprised by the loss of one or more lower appendages.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A field stretcher comprising
- a top end and a bottom end;
- a subject transporting portion;
- a perimeter around the top end, the bottom end, and the subject transporting portion;
- a subject retaining compartment for retaining a subject positioned within the subject transporting portion;
- a first means operable to gather up the bottom end and a portion of the subject transporting portion;
- a second means operable to gather up a portion of the top end;
- one or more handles connected at each end about the perimeter; and
- a loop positioned at the top end, the loop connected at each end to the perimeter, the total length of the loop greater than the one or more handles, the loop operable for dragging the stretcher along a surface
- wherein the bottom end and the portion of the subject transporting portion, in a drawn configuration is about 5 to about 30 percent reduced in length along its longitudinal axis of that of the field stretcher in an un-drawn configuration.

2. A field stretcher according to claim 1, wherein the loop is of a length for dragging the stretcher by a single person in an upright position.

3. A field stretcher according to claim 1, wherein the field stretcher has a first state having a compact form and a second state having an uncompacted form.

4. A field stretcher according to claim 1, wherein the loop is adjustable in length.

5. A field stretcher according to claim 1, wherein the subject retaining compartment further comprises a lower region and an upper region.

6. A field stretcher according to claim 5, wherein the upper region is gathered up independently from the lower region.

7. A field stretcher according to claim 1, wherein either the first and the second means operable to gather up comprises a drawing member selected from drawstrings, chains, straps, wire, ribbon, thread, or tape.

8. A field stretcher according to claim 7, wherein the drawstring member extends within a seam edge about the perimeter.

9. A field stretcher according to claim 1, wherein at least a portion of the subject transporting portion comprises a dual skin of material.

10. A field stretcher according to claim 9, wherein the subject transporting portion comprises a retaining compartment between portions of the dual skin of material.

11. A field stretcher according to claim 10, wherein the retaining compartment comprises a pad selected from a mattress pad, a heating pad, an absorbent pad, or combinations thereof.

12. A field stretcher according to claim 1, wherein at least a portion of the subject transporting portion comprises an abrasion resistant fabric, anti-static fabric, a flame-retardant fabric, or combinations thereof.

13. A field stretcher according to claim 1, wherein at least a portion of the subject transporting portion comprises an abrasion resistant coating, anti-static coating, a flame-retardant coating, or combinations thereof.

14. A field stretcher according to claim 1, further comprising an arrangement of openings on opposing edges of the subject transporting portion and at least one lace configured to be threaded through the arrangement of openings.

15. A field stretcher according to claim 14, further comprising one or more securement means positioned along the edges of the subject transporting portion for receiving the at least one lace.

16. A field stretcher according to claim 14, wherein the at least one lace is an elastomeric cord.

17. A method of transporting a subject generally horizontally, the method comprising
- providing a field stretcher as defined in claim 1;
- positioning a subject in the subject transporting portion;
- drawing at least a portion of the subject transporting portion about at least a portion of the subject; and
- transporting the field stretcher with the subject in a substantially horizontal position.

18. A method of claim 16, further comprising threading at least one lace through an arrangement of openings on opposing edges of the subject transporting portion, optionally securing the at least one lace.

* * * * *